US006360410B1

(12) United States Patent
Lovato

(10) Patent No.: US 6,360,410 B1
(45) Date of Patent: Mar. 26, 2002

(54) ADJUSTABLE STRAP BUCKLE

(75) Inventor: Attilio Lovato, Pino Torinese (IT)

(73) Assignee: National Molding Corp., Farmingdale, NY (US)

( * ) Notice: Subject to any disclaimer, the term of this patent is extended or adjusted under 35 U.S.C. 154(b) by 0 days.

(21) Appl. No.: 09/497,450

(22) Filed: Feb. 3, 2000

(30) Foreign Application Priority Data

Feb. 5, 1999 (IT) ..... T099A0088

(51) Int. Cl.[7] ..... A44B 11/26

(52) U.S. Cl. ..... 24/662; 24/170; 24/193; 24/625

(58) Field of Search ..... 24/662, 309, 310, 24/311, 313, 316, 614, 615, 625, 633, 170, 171, 191, 193, 265 BC, 265 EC; D11/215, 210

(56) References Cited

U.S. PATENT DOCUMENTS 4,567,628 A * 2/1986 Prete, Jr. et al. ..... 24/191 X
4,662,040 A * 5/1987 Terrell et al. ..... 24/625
4,800,629 A * 1/1989 Ikeda ..... 24/170
5,170,539 A * 12/1992 Lundstedt et al. ..... 24/313 X
5,621,953 A * 4/1997 Fildan ..... 24/191 X
5,774,947 A * 7/1998 Anscher ..... 24/171 X
5,893,199 A * 4/1999 Anscher ..... 24/625

* cited by examiner

*Primary Examiner*—Robert J. Sandy
(74) *Attorney, Agent, or Firm*—Collard & Roe, P.C

(57) ABSTRACT

A strap buckle comprises a male element and a female element which can be snap-fitted together and each of which has means for the connection of a respective portion of strap. The connection means include a device for adjusting the tension of the respective portion of strap, the device comprising two crosspieces which extend between two cheeks of the respective buckle element and define two slots which can be engaged by the strap, for which they define a tortuous path. The adjustment device includes a catch which is articulated to the cheeks about an axis parallel to the crosspieces and which can adopt a clamping position in which it interferes with the strap, preventing the strap from sliding in the slots, or a release position in which it is spaced from the strap.

7 Claims, 4 Drawing Sheets

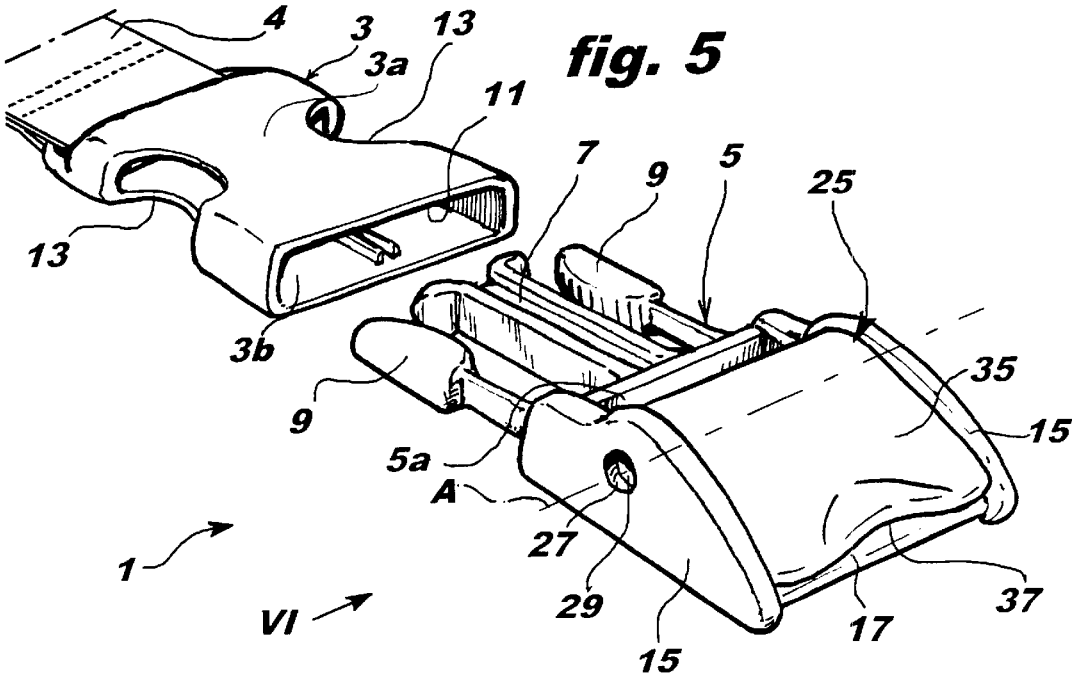
fig. 5
fig. 6a
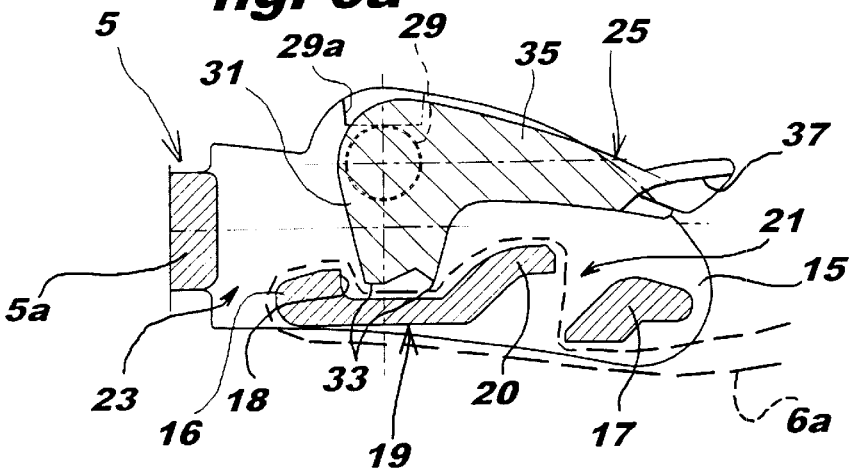

ADJUSTABLE STRAP BUCKLE

BACKGROUND OF THE INVENTION

1. Field of the Invention

The present invention relates to a strap buckle comprising a male element and a female element which can be snap-fitted together and each of which has means for the connection of a respective portion of strap, in which the connection means of one of the elements includes a device for adjusting the tension of the respective portion of strap, the device comprising two crosspieces extending between two cheeks of the respective element of the buckle so as to define two slots which can be engaged by the strap and intended to define a tortuous path for the strap.

2. The Prior Art

Known buckles of the type defined above are commonly used as quick closure devices for bags or rucksacks, or in other sports or leisure applications. However, these known buckles have the disadvantage that the device which is provided for adjusting the tension of one of the portions of the strap, and which is associated, for example, with the male element of the buckle, can clamp the strap effectively after the desired adjustment has been achieved only if the buckle maintains an inclination below a predetermined threshold. In the more general case, if the body with which the buckle is associated is subject to fairly violent movements to and fro, the adjustment device is also subject to cycles of varying loading which may cause the adjustment device to adopt, even for very short periods of time, an inclination greater than the maximum provided for in order to maintain the adjustment tension of the strap. In this case, the strap may loosen progressively until it is unthreaded from the respective buckle element as a result of gradually increasing play between the strap and the buckle.

Moreover, in buckles of the known type identified above, the relative arrangement of the crosspieces of the adjustment device is the sole means for clamping the strap. In particular, their arrangement is such that the strap can be clamped only if it is arranged so as to engage both of the slots of the adjustment device in a particular arrangement. However, this effective arrangement is not always easily and quickly identified by the user and, if the strap is arranged in the slots in the other possible, incorrect, arrangement, the strap inevitably tends to separate from the buckle even if a slight tension is applied to it.

SUMMARY OF THE INVENTION

In order to prevent the above-mentioned problems, the subject of the invention is a buckle of the type defined above, characterized in that the adjustment device comprises a catch which is articulated to the cheeks about an axis substantially parallel to the crosspieces, and which is adapted to adopt a clamping position in which it interferes with the strap, preventing the strap from sliding in the slots, or a release position in which the catch is spaced from the strap.

By virtue of this concept, the buckle according to the invention is very secure with respect to accidental sliding of the strap in the slots of the adjustment device, even if the buckle is subjected to cycles of violent loading.

Moreover, the strap can engage the slots of the adjustment device in two possible configurations, that is, following two different tortuous paths, in both of which the strap can be clamped effectively, rendering the insertion of the strap in the device and its subsequent clamping easier, quicker and more secure.

By virtue of the fact that the adjustment device, which is usually associated with the male element of the buckle, comprises the articulated catch, its cheeks are larger than those of the buckles of the prior art, precisely to permit the articulation of the catch, thus facilitating gripping and operation of the respective buckle element, for example, during the snap-coupling of the buckle, even for a user wearing gloves, as may be the case during sports activities which require equipment having quick-fit buckles, so that the buckle according to the invention can be manipulated in a more practical and secure manner than the buckles already known in the prior art.

BRIEF DESCRIPTION OF THE DRAWINGS

Further characteristics and advantages of the invention will become clearer from a reading of the following detailed description, given purely by way of non-limiting example, with reference to the appended drawings, in which:

FIG. 5 is a view similar to FIG. 1 in which the device for adjusting the tension of the strap is in its closed configuration, in the absence of the strap, FIGS. 6*a,* 6*b* are similar, sectioned side elevational views taken from the side indicated by the arrow VI in FIG. 5, showing, respectively, the two possible configurations in which the strap can be associated with the same element of the buckle of FIG. 5, in the condition in which the strap is clamped.

DETAILED DESCRIPTION OF THE PREFERRED EMBODIMENTS

Figure 1:
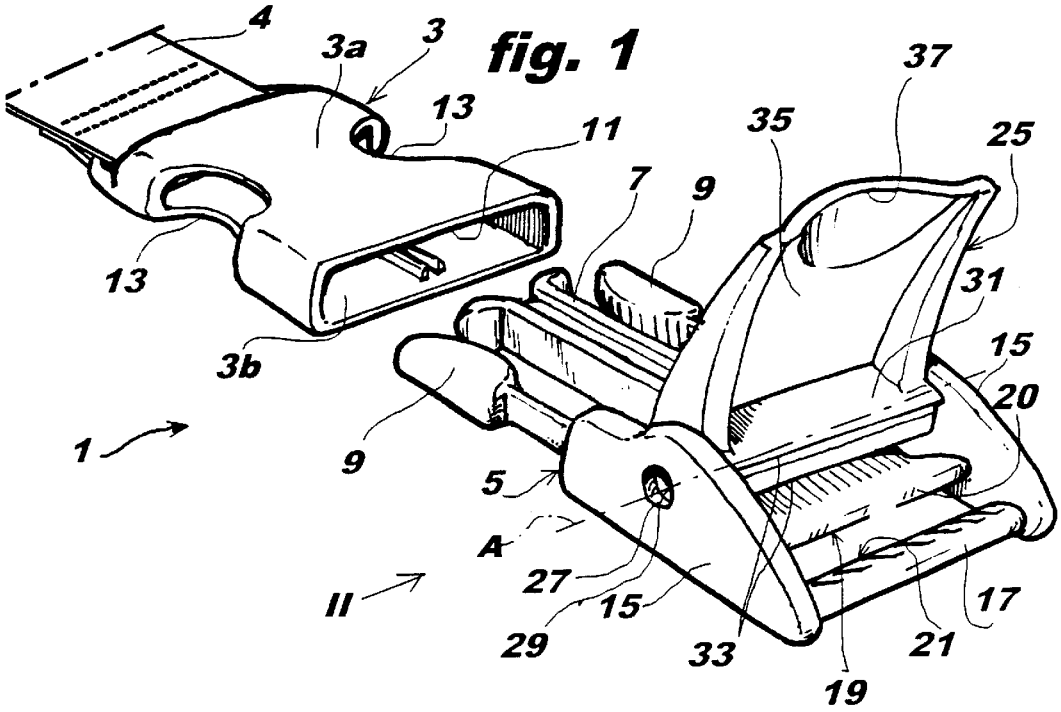
FIG. 1 is an exploded perspective view of a strap buckle according to the invention, with the adjustment device in its open configuration, and in the absence of the strap.
Figure 2A:
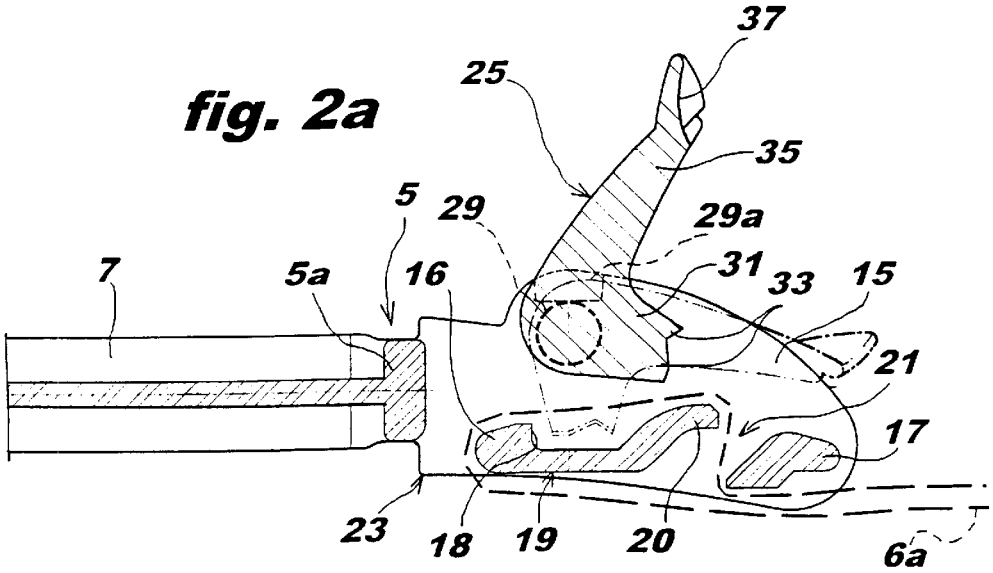
FIGS. 2*a* and 2*b* are similar, sectioned side elevational views taken from the side indicated by the arrow II in FIG. 1, showing two possible configurations in which a strap can be associated with the same element of the buckle of FIG. 1, FIGS. 3 and 4 are views similar to FIGS. 2*a,* 2*b.* which show two embodiments of the adjustment device which differ from those shown in FIGS. 2*a* and 2*b,*

With reference initially to FIGS. 1, 2*a,* 2*b,* 5, 6*a* and 6*b,* a buckle 1 according to the invention is made of moulded plastics material and comprises a female element 3 having a top wall 3*a* and a bottom wall 3*b* between which a cavity 11 is defined. The element 3 has a transverse bar enabling a fixed end loop of a respective portion of strap 4 to be connected to the element 3.

A portion of a male element 5 of the buckle 1 comprising a guide rod 7 interposed between two resilient prongs 9 can be snap-engaged in the female element 3. As a result of the insertion of the rod 7 and of the prongs 9 in the cavity 11 of the female element 3, the prongs 9 first of all deform slightly towards the rod 7 as a result of interference with side walls of the element 3 and then return to their undeformed condition when they come into engagement with respective lateral seats 13 formed in the side walls of the female element 3, thus achieving mutual anchorage of the female and male elements 3 and 5 of the buckle 1. If the portions of the prongs 9 disposed in the seats 13 of the element 3 are pushed towards the rod 7, the male element 5 can be released from the female element 3.

The male element 5 has a main crosspiece 5*a* to which the rod 7 and the prongs 9 are connected and from which two cheeks 15 extend in the opposite direction to the prongs 9. The cheeks 15 are also connected to one another by an intermediate crosspiece 19 and by an end crosspiece 17 which are arranged in a plane substantially parallel to a general plane of the male element 5, substantially parallel to the rod 7. In particular, the crosspiece 17 has a beak-like shape, and the intermediate crosspiece 19 is generally elongate and has an outer recess which extends between an end 20 facing the crosspiece 17 and an opposite end 16 facing the crosspiece 5*a*. In the vicinity of the end 16, the recess of the crosspiece 19 is defined axially by a shoulder 18 substantially perpendicular to the general plane of the element 5.

Two parallel slots, indicated 21 and 23, are defined between the crosspieces 17 and 19 and between the crosspieces 19 and 5*a*, respectively. These slots are intended to be engaged by the portion of strap associated with the element 5 of the buckle which is inserted through the slots so as to follow a tortuous path, that is, with a portion of the strap arranged so as to be substantially S-shaped.

Figure 2B:
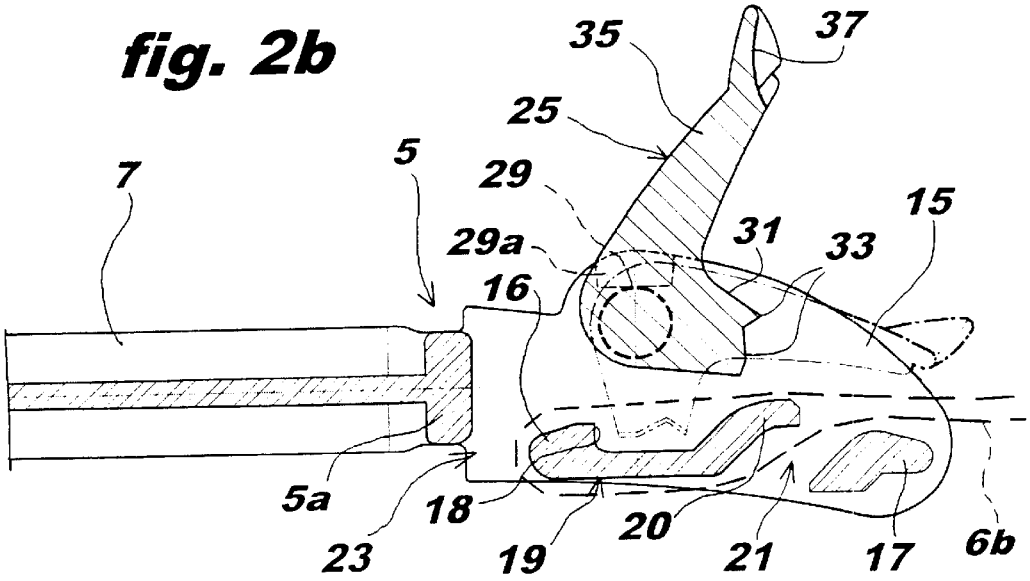
Figure 6B:
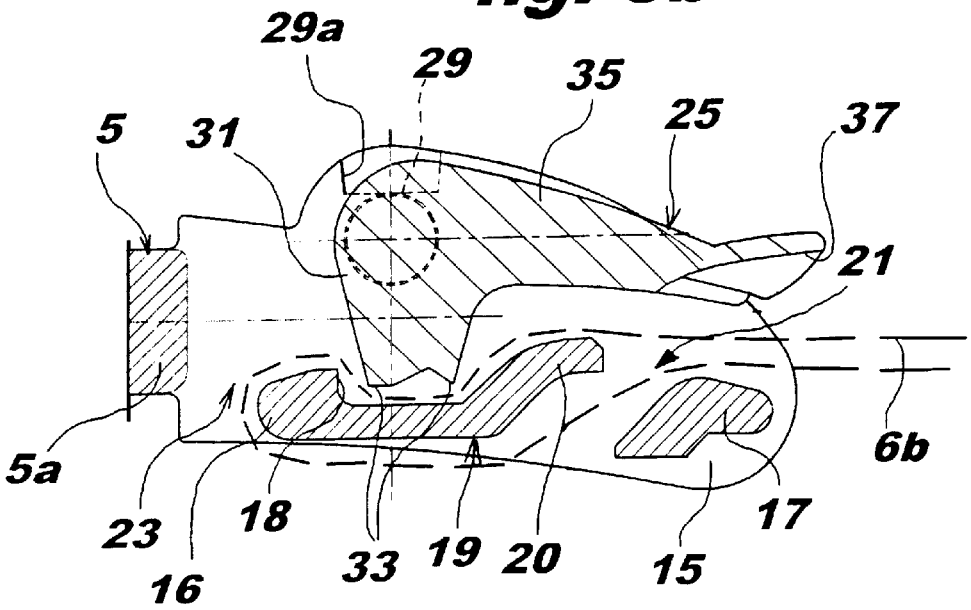

In particular, the strap can be associated with the slots 21 and 23 in two different configurations, of which one is indicated 6*a* in FIGS. 2*a* and 6*a*, and the other is indicated 6*b* in FIGS. 2*b* and 6*b*. In the configuration 6*a*, the strap extends around the crosspiece 19 and both portions of the strap extend under the crosspiece 17, whereas in configuration 6*b*, the strap still extends around the crosspiece 19 but both of its portions extend over the crosspiece 17.

A catch 25 associated with the cheeks 15, above the crosspiece 19*a*, is articulated about an axis A (FIGS. 1 and 5) substantially parallel to the crosspieces 19 and 17. The catch 25 is substantially L-shaped so as to have a portion 31 for restraining the strap and an operating portion 35, which are generally perpendicular to one another. Two coaxial pins 29 extend on the outside of the catch 25 in the region of the connection of the portions 31 and 35, in order to engage corresponding holes 27 in the cheeks 15. Two opposed slide-ways 29*a* are advantageously formed on the inner faces of the two cheeks 15 to facilitate the snap-engagement of the pins 29 in the respective holes 27 during the coupling of the catch 25 with the cheeks 15.

The restraining portion 31 preferably has at least a pair of teeth 33 at its free end for interfering with the surface of the strap 6*a* or 6*b* in order to clamp it in the outer recess of the crosspiece 19 in the strap-clamping configuration. In this clamping configuration, the portion 31 of the catch 25 is arranged in abutment with the shoulder 18, with the interposition of the strap, after passing a dead-point angular position which corresponds, for example, to the position of the portion 31 when it is perpendicular to the general plane of the male element 5, so that the catch 25 stops in a stable manner in the strap-clamping configuration.

The operating portion 35 of the catch 25 preferably has a projecting end edge 37 to facilitate gripping thereof by a user's finger when the catch 25 is to be rotated about the axis A from its strap-clamping configuration, first of all passing the above-mentioned dead point, until it reaches the position of FIGS. 1, 2*a* or 2*b*.

Figure 3:
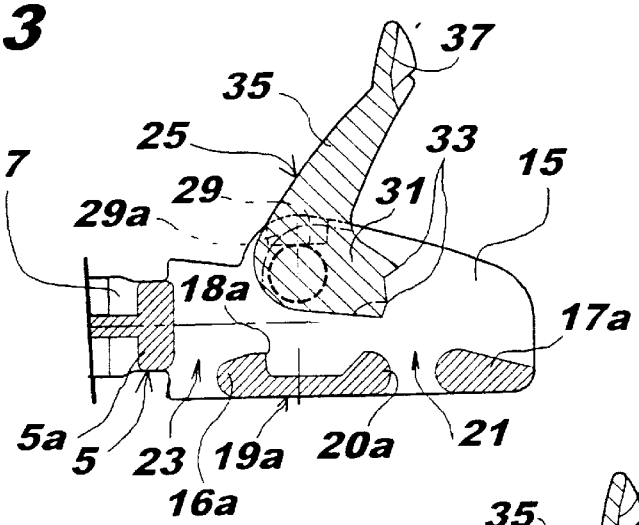
Figure 4:
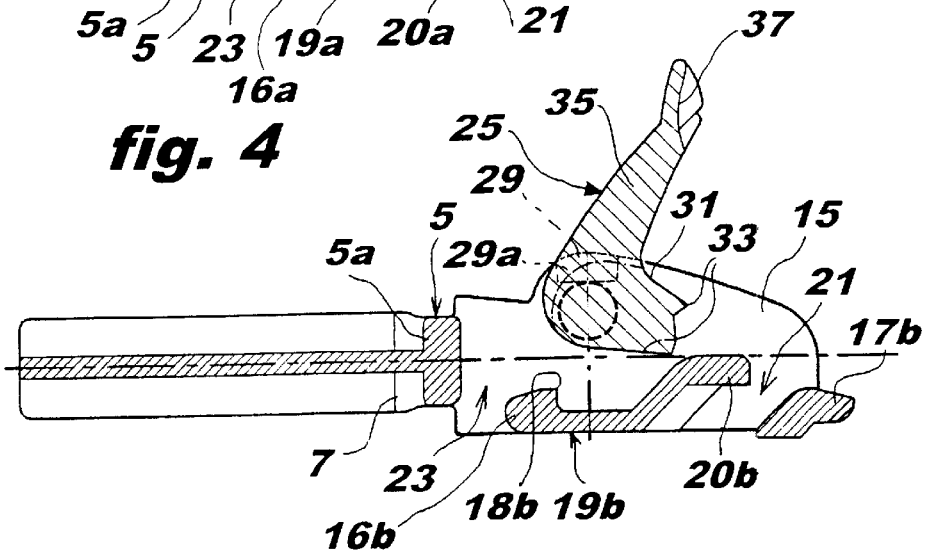

In FIGS. 3 and 4, in which the same reference numerals as in FIGS. 1, 2*a* and 2*b* have been used to indicate identical or similar parts, the intermediate and end crosspieces, indicated 17*a*, 19*a* and 17*b*, 19*b*, respectively, have a different shapes from those shown in FIGS. 2*a* and 2*b*.

The crosspiece 17*a* is generally drop-shaped and the crosspiece 19*a* is substantially flat, and both are generally smaller than the corresponding crosspieces 17 and 19 and are substantially aligned axially so that both of the slots 21 and 23 have axes perpendicular to the general plane of the element 5. The crosspiece 17*b* on the other hand has an angled shape and projects from the element 5 in the opposite direction to the main crosspiece 5*a*, and the crosspiece 19*b* has an elongate shape the end 20*b* of which almost overlaps the crosspiece 17*b* so that the slot 21 is relatively narrow and its general axis is inclined at about 45° to the general plane of the element 5, that is, slightly more inclined than the axis of the slot 21 defined between the crosspieces 17 and 19.

In particular, the more or less marked inclination of the axis of the slot 21 defines a limit angle between the element 5 and the respective portion of strap which extends therefrom, beyond which limit angle the strap which engages the tension adjustment device in the configuration 6*a* tends to slide relative to the slots 21 and 23 if a pulling force is applied to the strap.

Figure 7:
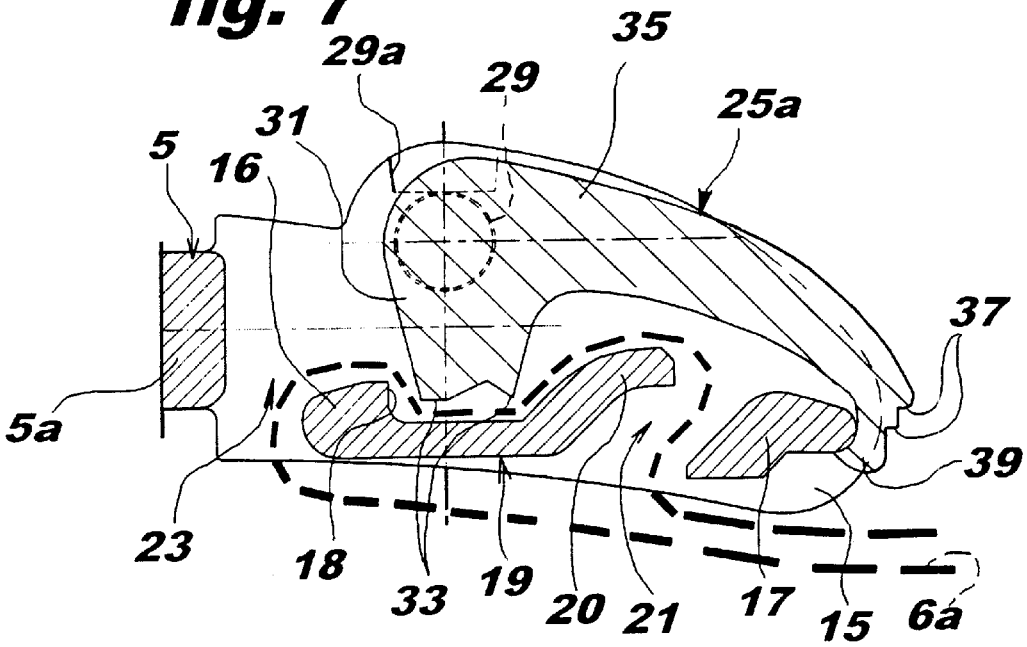
FIG. 7 is a view similar to FIG. 6*a*, showing a variant of the invention.

FIG. 7 shows a variant of the buckle 1 in which the catch 25 has auxiliary engagement means consisting of two end hooks 39 which can snap-engage the crosspiece 17 as a result of a pressure exerted on the portion 35 of the catch 25 so as to constitute an additional safety measure for preventing the catch 25 from accidentally reaching the strap-release position, in order to avoid undesired sliding of the strap relative to the element 5.

In the adjustment device of the buckle 1, irrespective of the shape and relative arrangement of its intermediate and end crosspieces which are selected in dependence on the designed limit angle with respect to the sliding of the strap when it is arranged in the configuration 6*a*, the strap can also engage the slots 21 and 23 and can be clamped effectively by means of the catch 25 in the configuration 6*b*, in contrast with known buckles in which the insertion of the strap in the configuration 6*b* inevitably results in the strap becoming unthreaded from the element 5. In particular, the configuration 6*a* of the strap enables effective clamping to be achieved even if the catch 25 is accidentally released, whilst configuration 6*b* has the advantage that, when the catch 25 adopts its strap-clamping position, it can be brought to the strap-release position by the application of a pull to its free end so that consequent lifting of the strap lifts the catch 25 relative to the crosspiece 17, owing to interference with the portion 35 of the catch 25, spacing the portion 31 from the surface of the strap. Since both of the configurations 6*a* and 6*b* of the strap enable effective clamping thereof to be achieved, the buckle according to the invention can be connected to the respective portion of strap more easily and securely and the possibility of the strap being separated accidentally owing to its being arranged incorrectly is excluded.

Moreover, the portion 35 of the catch 25 acts as a covering element for the respective portion of strap, particularly its regions extending around the crosspieces 17, 19 and facing outwardly relative to the buckle 1, which regions bear on relatively rigid elements and are most exposed to wear should the buckle rub against a rough surface.

The cheeks 15 are substantially larger than the cheeks of adjustment devices of the prior art so as to be able to accommodate the holes 27 for the pins 29 of the catch 25 and to allow the portion 31 to rotate about the axis A above the crosspiece 19. As a consequence of this larger size, the outer gripping surfaces of the cheeks 15 are wider which enables them to be gripped more conveniently by the user, particularly if he is wearing gloves, especially during the insertion of the male element 5 in the female element 3 to fit these elements together.

What is claimed is:

1. A strap buckle comprising:

a male element;

a female element that can be snap-fitted to the male element;

a means disposed on the male and female element for connecting a respective portion of the strap, said connecting means comprising:

a device for adjusting the tension of the respective portion of the strap, said device comprising:

a main crosspiece, an intermediate crosspiece and an end crosspiece extending between two cheeks of the respective element of the buckle, the main and the intermediate crosspieces defining a first slot, the intermediate and end crosspieces defining a second slot, the slots can be engaged by the strap and for defining a tortuous path for the strap;

a substantially L-shaped catch being articulated to the cheeks about an axis substantially parallel to the crosspieces and adapted to adopt a clamping position that interferes with the strap preventing the strap from sliding in the slots, or a release position in which the catch is spaced from the strap; said catch comprising a restraining portion for restraining the strap, said portion having an end for interfering with the surface of the strap when the strap engages the slots, and an operating portion disposed on the outside of the buckle having auxiliary means for snap-engagement on one of the crosspieces in the position for clamping the strap.

2. A buckle according to claim 1, wherein the catch is associated with the male element of the buckle.

3. A buckle according to claim 1, wherein the crosspieces are arranged substantially in a plane parallel to the general plane of the buckle, and in that the articulation axis of the catch is spaced from the plane defined by the crosspieces.

4. A buckle according to claim 1, wherein the restraining portion has at least a pair of end teeth.

5. A buckle according to claim 1, wherein the operating portion of the catch has a projecting lead-in edge for facilitating its gripping and movement by means of a user's finger, starting from the position for clamping the strap.

6. A buckle according to claim 1, wherein the operating portion of the catch is formed so as to constitute an element for covering the strap in the clamping position.

7. A buckle according to claim 1, wherein the restraining portion can come substantially into abutment with an angular-travel limit shoulder formed in one of said main, intermediate and end crosspieces, when the restraining portion is in its position for clamping the strap.

* * * * *